US010088793B2

(12) United States Patent
Yokochi

(10) Patent No.: US 10,088,793 B2
(45) Date of Patent: Oct. 2, 2018

(54) POST-PROCESSING APPARATUS AND CONTROL METHOD FOR CONTROLLING THE POST-PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hidetoshi Yokochi, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/406,856

(22) Filed: Jan. 16, 2017

(65) Prior Publication Data

US 2018/0203401 A1 Jul. 19, 2018

(51) Int. Cl.
*G03G 15/00* (2006.01)

(52) U.S. Cl.
CPC ..... *G03G 15/70* (2013.01); *G03G 15/6541* (2013.01)

(58) Field of Classification Search
CPC ..... G03G 15/70
USPC ..... 399/21
See application file for complete search history.

(56) References Cited

U.S. PATENT DOCUMENTS 5,159,395 A * 10/1992 Farrell ..... G03G 15/234 271/291
5,493,378 A * 2/1996 Jamzadeh ..... G03G 15/2064 219/216
5,689,795 A * 11/1997 Mastrandrea ..... B65H 5/00 271/202
6,071,352 A * 6/2000 Sugie ..... B41M 7/0009 134/1
6,831,732 B2 * 12/2004 Fukushima ..... G03B 27/00 355/27
2004/0190895 A1 * 9/2004 Iida ..... G03B 27/32 396/616
2007/0071529 A1 * 3/2007 Lee ..... G03G 15/1605 399/400
2009/0140487 A1 * 6/2009 Takahashi ..... B41J 11/007 271/10.01
2010/0196063 A1 * 8/2010 Iguchi ..... B41J 3/546 399/322
2016/0159129 A1 * 6/2016 Iguchi ..... B41J 2/32 347/179

FOREIGN PATENT DOCUMENTS

JP 2016-109935 6/2016

* cited by examiner

*Primary Examiner* — Anthony Nguyen
(74) *Attorney, Agent, or Firm* — Patterson & Sheridan, LLP

(57) ABSTRACT

A post-processing apparatus includes a post-processing section configured to execute post-processing on a sheet conveyed from an image forming section, and a controller configured to set a first post-processing speed or a first number of sheets to be post-processed if the post-processing section is performing the post-processing on first sheets, and a second post-processing speed or a second number of sheets to be post-processed if the post-processing section is performing the post-processing on second sheets. The second sheets are sheets that have been decolored at least a predetermined number of times, and the first sheets are sheets that have been decolored less than the predetermined number of times.

20 Claims, 10 Drawing Sheets

POST-PROCESSING APPARATUS AND CONTROL METHOD FOR CONTROLLING THE POST-PROCESSING APPARATUS

FIELD

Embodiments described herein relate generally to a post-processing apparatus and a control method for the post-processing apparatus.

BACKGROUND

Multi-Function Peripherals (MFPs) having a decoloring function are known. Decoloring indicates removing a color of an image that has been printed with decolorable toner. The MFP removes the color of the image by heating the sheet bearing the decolorable toner.

The MFP typically includes a cassette for new sheets and a cassette for decolored sheets. The MFP sometimes forms images on the decolored sheets.

A post-processing apparatus aligns sheets on a processing tray and performs a post-processing such as a stapling process or a sorting process. The post-processing apparatus discharges a bundle of the sheets to a discharge tray.

However, in the post-processing apparatus, a deficiency sometimes occurs in conveyance of a decolored sheet. If a sheet is decolored, the sheet often loses its stiffness and may easily curl. Such deformation can cause a jam or alignment failure in the post-processing apparatus.

DETAILED DESCRIPTION

Figure 1:
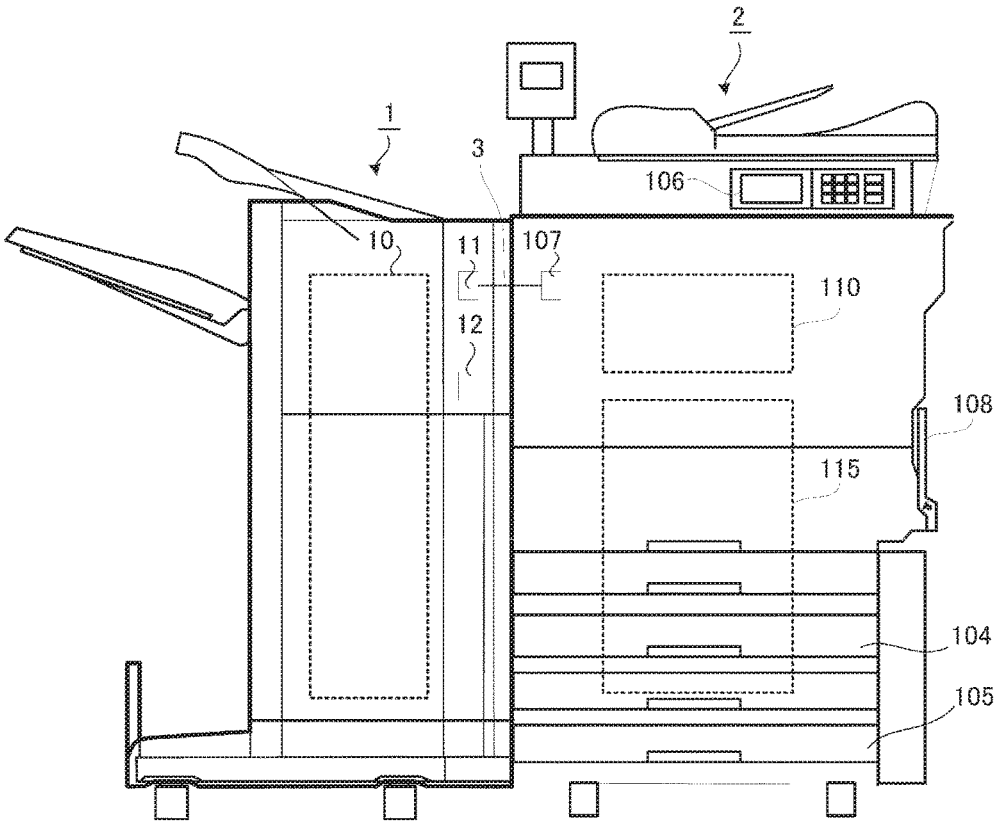
FIG. 1 is a configuration diagram of a post-processing apparatus according to an embodiment.

A post-processing apparatus according to an embodiment includes a post-processing section configured to execute post-processing on a sheet conveyed from an image forming section, and a controller configured to set a first post-processing speed or a first number of sheets to be post-processed if the post-processing section is performing the post-processing on first sheets, and a second post-processing speed or a second number of sheets to be post-processed if the post-processing section is performing the post-processing on second sheets. The second sheets are sheets that have been decolored at least a predetermined number of times, and the first sheets are sheets that have been decolored less than the predetermined number of times.

A method of controlling a post-processing apparatus includes receiving a signal that indicates that a sheet conveyed from an image forming section to a post-processing section is a first sheet or a second sheet, wherein the second sheet is a sheet that has been decolored at least a predetermined number of times, and the first sheet is a sheet that has been decolored less than the predetermined number of times, setting a post-processing speed or number of sheets to be post-processed based on the signal, executing post-processing on the sheet conveyed from the image forming section according to the set post-processing speed or the set number of sheets to be post-processed.

A post-processing apparatus and a control method for the post-processing apparatus according to an embodiment are explained in detail below with reference to the accompanying drawings as an example. Note that, in figures, the same components are denoted by the same reference numerals and signs and redundant explanation of the components is omitted.

FIG. 1 is a configuration diagram of an MFP 2 coupled to a post-processing apparatus 1 according to the embodiment.

The MFP 2 is capable of printing and decoloring. In a decoloring mode, the MFP 2 discharges the sheet decolored by the decoloring section 110. In a printing mode, the MFP 2 fixes an image on a sheet sent from a printing section 115 and prints, with a decoloring section 110 functioning as a fixing device. In the normal printing mode, the MFP 2 can print a new sheet. In a different printing mode, the MFP 2 can print using a decolored sheet.

The post-processing apparatus 1 includes a receiving section 11, a post-processing section 10, and a controller 12. The receiving section. 11 receives a signal from the MFP 2 that indicates whether printing or decoloring is performed on a sheet. The post-processing section 10 executes post-processing on the sheet conveyed from the MFP 2. For example, the post-processing may be any of, or any combination of, sorting, stapling, punching, and folding.

The controller 12 controls the post-processing section 10 to reduce post-processing speed for the decolored sheet to be lower than post-processing speed for the printed sheet. The controller 12 determines, on the basis of the signal received by the receiving section 11, whether the sheet conveyed from the MFP 2 is the decolored sheet or the printed sheet. The controller 12 reduces, according to a determination result, conveying speed, aligning operation speed, and discharge speed for the decolored sheet to be low compared with conveying speed, aligning operation speed, and discharge speed in discharging the printed sheet. In addition, the controller 12 reduces conveying speed, aligning operation speed, and discharge speed, according to a determination result, for a printed decolored sheet compared with a printed non-decolored sheet.

Figure 2:
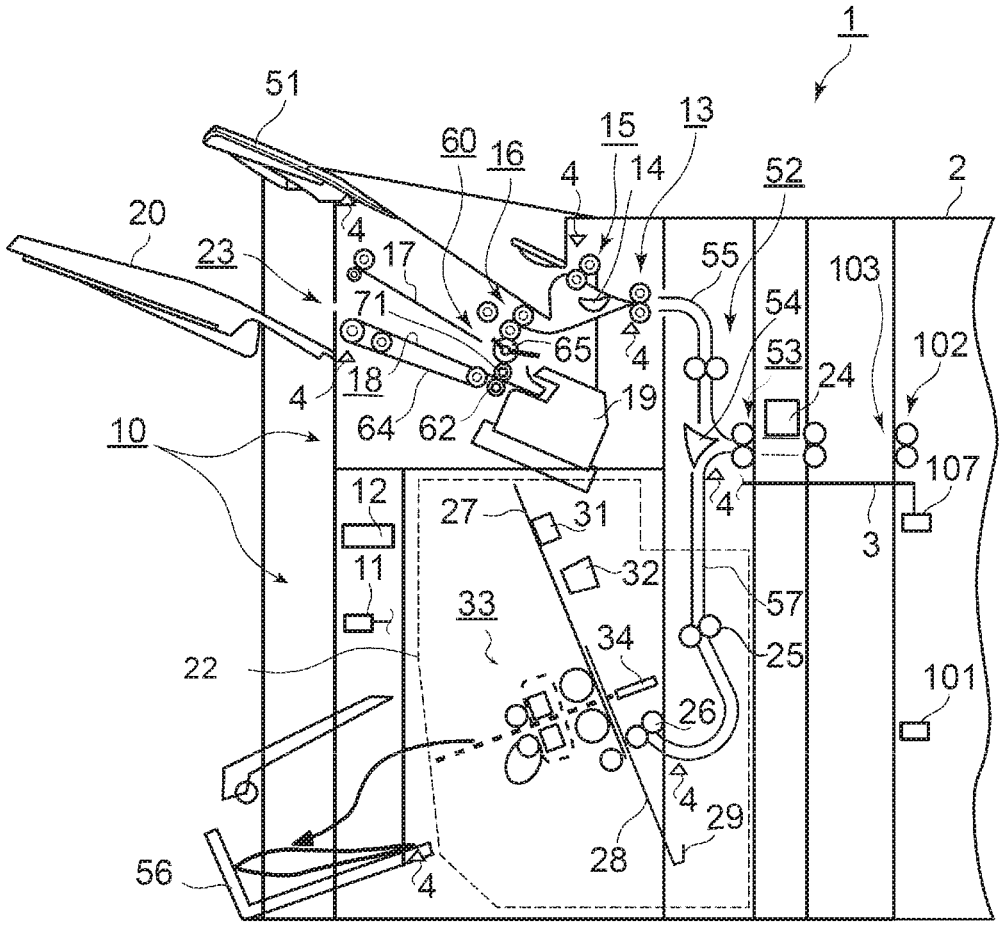
FIG. 2 is a diagram showing a configuration example of a post-processing section of the post-processing apparatus.

FIG. 2 is a diagram showing a configuration example of the post-processing section 10 of the post-processing apparatus 1. The repeated reference numerals represent components described above.

The MFP 2 discharges a sheet with a pair of discharge rollers 102. The post-processing apparatus 1 includes a puncher 24. The puncher 24 opens holes in the sheet. The post-processing apparatus 1 includes a sheet dividing section 52 that diverts the sheet to a saddle machine 22 side or a fixed tray 21 side. The post-processing apparatus 1 sorts a sheet bundle with a processing tray 18 and staples the sheet bundle with a stapler 19, A number of sheets stapled by the stapler 19 can be changed according to a command from the controller 12.

The post-processing apparatus 1 folds the sheet bundle using the saddle machine 22 and a saddle folding unit 33.

The sheet dividing section 52 includes a supply port 53 connected to a discharge port 103, a flapper 54 that guides a sheet to an upper sheet conveying path 55, continuing to the fixed tray 21, or a lower sheet conveying path 57, continuing to a saddle tray 56.

The post-processing apparatus 1 includes a pair of inlet rollers 13 and a flapper 14 on the upper sheet conveying path 55 side. The inlet rollers 13 draw in a sheet from the upper sheet conveying path 55. The flapper 14 switches a path of the sheet from the inlet rollers 13 to an upward direction or a downward direction. The flapper 14 guides the sheet to a pair of outlet rollers 15 according to notification from the MFP 2 to the controller 12 indicating absence of stapling. The outlet rollers 15 discharge the sheet onto the fixed tray 21. The flapper 14 guides the sheet to a pair of paper feeding rollers 16 according to notification indicating presence of stapling.

The post-processing apparatus 1 includes a standby tray 17, the processing tray 18, the stapler 19, and a discharge tray 20.

Figure 3:
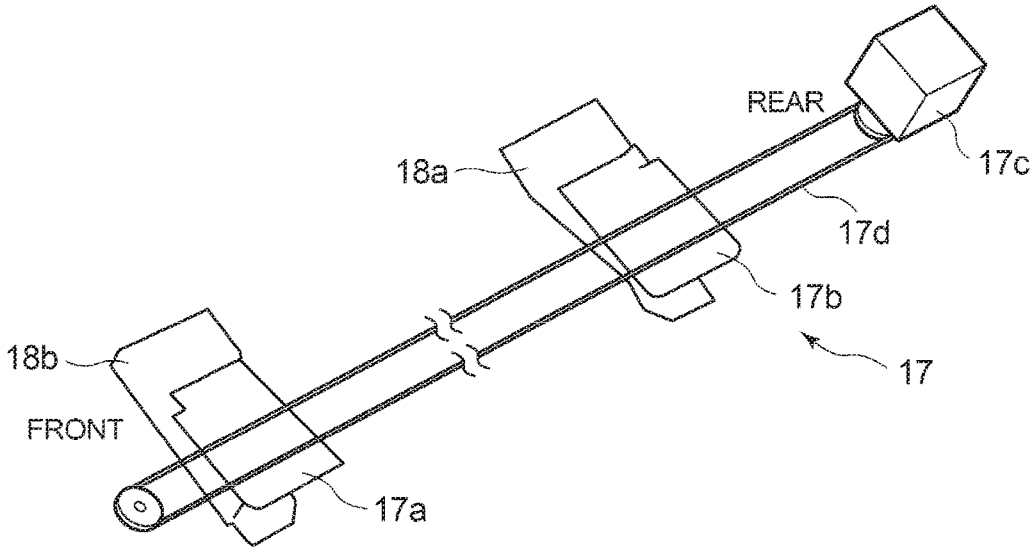
FIG. 3 is a perspective view of a standby tray of the post-processing apparatus.

FIG. 3 is a perspective view of the standby tray 17. The figure shows tables 18*a* and 18*b* of the processing tray 18. The standby tray 17 puts a sheet reaching the standby tray 17 on standby until stapling of a sheet bundle having already reached the processing tray 18 is completed. The standby tray 17 slides a buffer tray 17*a* nearest a front side of the post-processing apparatus 1 toward the front side and slides a buffer tray 17*b* nearest a rear side of the post-processing apparatus 1 toward the rear side. The standby tray 17 thus causes a sheet to drop, when the buffer trays 12*a* and 17*b* move to a separation distance greater than a dimension of the sheet, according to the sliding of the buffer trays 17*a* and 17*b*. A buffer motor 17*c* drives movement of a belt 17*d*. The belt 17*d* moves the buffer trays 17*a* and 17*b* toward the front and rear of the post-processing apparatus 1.

Figure 4:
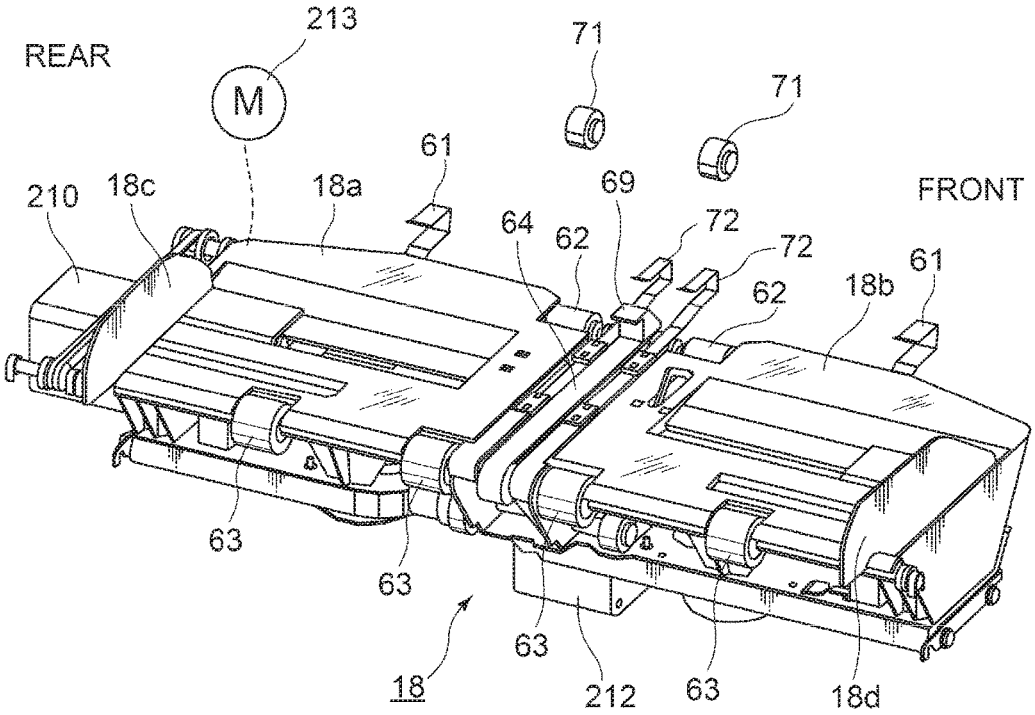
FIG. 4 is a perspective view of a processing tray of the post-processing apparatus.

FIG. 4 is a perspective view of the processing tray 18. The stapler 19 is inside the apparatus shown in FIG. 4, and is therefore not visible in FIG. 4. The processing tray 18 aligns, below the standby tray 17 (FIGS. 2, 3), a sheet bundle in each of a lateral direction and a longitudinal direction of the sheet bundle. The processing tray 18 ejects the stapled sheet bundle from a discharge port 23 to the discharge tray 20 (FIG. 2). The longitudinal direction indicates a direction parallel to a sheet conveying direction. The lateral direction indicates a direction orthogonal to the sheet conveying direction.

The processing tray 18 executes a lateral alignment function with a lateral alignment plate 18*c* on the table 18*a*, a lateral alignment plate 18*d* on the table 18*b*, and a lateral alignment motor 213. The sheet dropped from the standby tray 17 is placed on the tables 18*a* and 18*b*. The lateral alignment motor 213 moves the lateral alignment plates 18*c* and 18*d* back and forth in the lateral direction using a belt (not shown) to align the sheet in the lateral direction.

The processing tray 18 executes a longitudinal alignment function with a pair of upper longitudinal alignment rollers 71, a pair of lower longitudinal alignment rollers 62, four discharge rollers 63, a longitudinal alignment motor 210, and one or more paddles 65 (FIG. 2). The processing tray 18 brings the trailing end of the sheet into contact with left and right stoppers 61 and longitudinally aligns the sheet. The upper longitudinal alignment rollers 71 and the lower longitudinal alignment rollers 62 hold the stapled sheet bundle and pull the sheet bundle from the stapler 19. The discharge rollers 63 are located on the leading end side of the sheet. The longitudinal alignment motor 210 drives to rotate the lower longitudinal alignment rollers 62, the upper longitudinal alignment rollers 71, and the discharge rollers 63 using respective belts (not shown.).

As shown in FIG. 2, the paddles 65 are located above the stoppers 61 and obliquely below the standby tray 17. The paddles 65 are made of rubber and have elasticity. The paddles 65 rotate to push the sheet down. The paddles 65 align the top sheet of the sheet bundle in the longitudinal direction.

The processing tray 18 (FIG. 4) executes an eject function with a pair of ejectors 72. The ejectors 72 move a reciprocating fashion to ascend an inclined surface and descend the inclined surface. The ejectors 72 are attached to a binding nail belt 64. The ejectors 72 are driven in a reciprocating motion by the binding nail belt 64.

Figure 5:
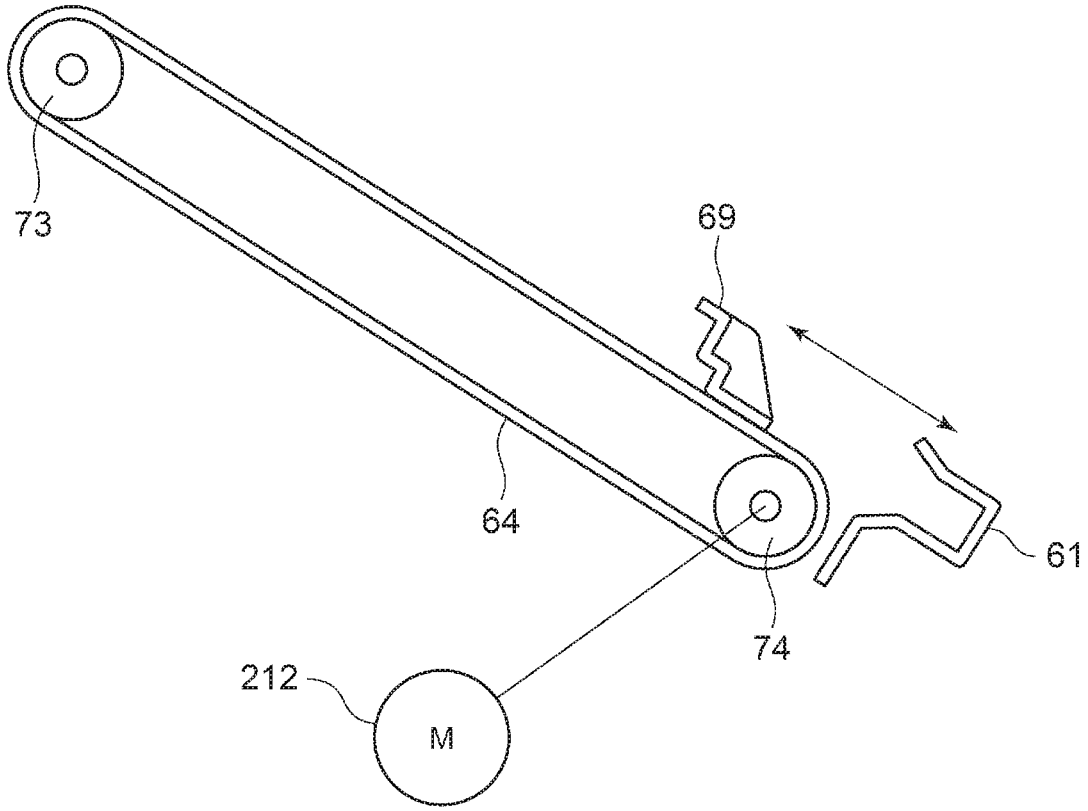
FIG. 5 is a configuration diagram of ejectors and a binding nail belt used in the processing tray of the post-processing apparatus.

FIG. 5 is a diagram showing a configuration example of the binding nail belt 64. A binding nail 69 is provided in the binding nail belt 64. The binding nail belt 64 is wound between pulleys 73 and 74. The pulleys 73 and 74 are driven to rotate by a binding nail belt motor 212. The binding nail 69 catches sheets. The binding nail belt 64 conveys sorted or stapled sheets, and discharges the sheets from the discharge port 23 to the discharge tray 20 (FIG. 2).

Figure 6:
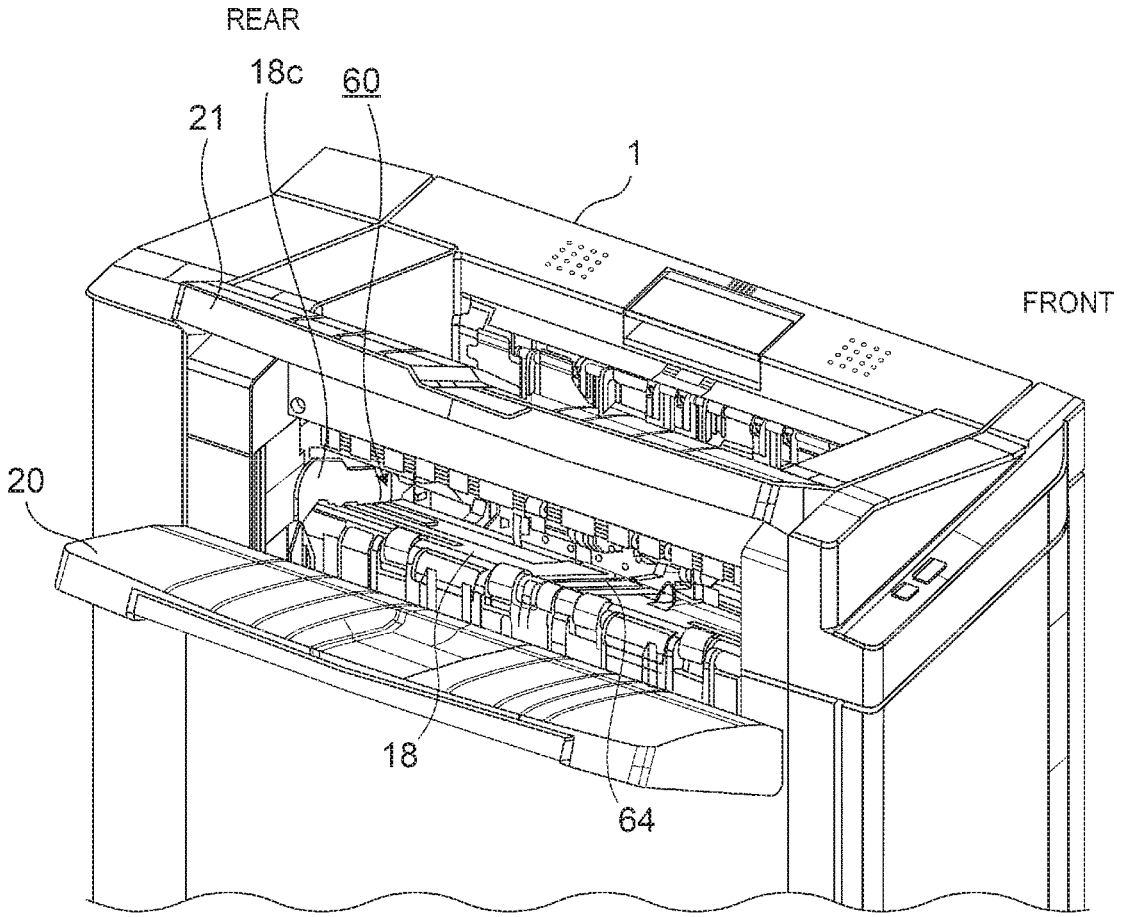
FIG. 6 is a perspective view of the post-processing apparatus viewed from a discharge side.

FIG. 6 is a perspective view of the post-processing apparatus 1 viewed from a discharge side. The discharge tray 20 is a tray to which a post-processed sheet is discharged. The discharge tray 20 is a movable tray that moves up and down. Several thousand sheets can be placed on the discharge tray 20.

The post-processing apparatus 1 includes a buffer section 6U between the standby tray 17 and the processing tray 18 (FIG. 2). The buffer section. 60 temporarily holds up a plurality of sheets conveyed from the MFP 2 in the standby tray 17, places a subsequent sheet on the held-up sheets, and drops the sheets onto the processing tray 18.

Figure 7:
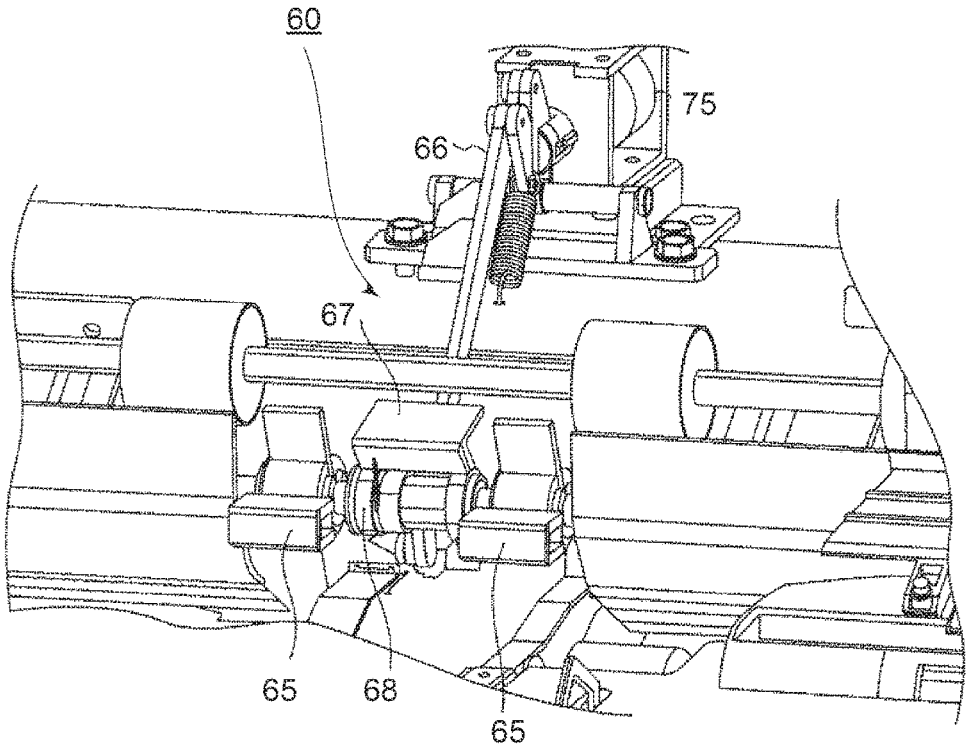
FIG. 7 is a perspective view of a buffer section of the post-processing apparatus viewed from the discharge side.

FIG. 7 is a perspective view of the buffer section 60 viewed from the discharge side. The buffer section 60 includes the standby tray 17, two paddles 65, a trailing end retainer 67 between the two paddles 65, a torsion spring 68, a rod 66, and an actuator 75. The trailing end retainer 67 is capable of rotating around a horizontal shaft (not visible in FIG. 7). The actuator 75 pushes the rod 66 toward the trailing end retainer 67, thus rotating the trailing end retainer 67. One surface of a sheet trailing end is brought into contact with the upper surfaces of horizontal blades of the paddles 65. The other surface of the sheet trailing end is pressed by the trailing end retainer 67. The trailing end retainer 67 presses the trailing ends of a set number of sheets to put the sheets on standby. Conversely, when the actuator 75 moves the rod 66 away from the trailing end retainer 67, the trailing end retainer 67 is rotated in the opposite direction by the torsion spring 68. The paddles 65 are rotated downward (in the view of FIG. 7), and the set number of sheets drop to the processing tray 18.

Referring back to FIG. 2, the saddle machine 22 binds the center of the sheets and folds the sheet bundle. The saddle machine 22 may drive a needle into the sheet bundle. The saddle machine 22 outputs a bound booklet to the saddle tray 56. The saddle machine 22 conveys a sheet to a tray 27 via a pair of intermediate rollers 25 and a pair of outlet rollers 26. The surface of the tray 27 is inclined. Below the tray 27, a stacker 28 stacks a plurality of sheets. The stacker 28 forms a sheet bundle and aligns the lower end of the sheet bundle with a stopper 29. The stacker 28 reciprocates in a sheet conveying direction.

The saddle machine 22 aligns the sheet bundle in the lateral direction with another pair of lateral alignment plates 31. The saddle machine 22 staples the sheet bundle with a stapler 32.

The post-processing apparatus 1 includes the saddle folding unit 33. The saddle folding unit 33 folds the sheet bundle with a sheet surface pushed by a blade 34 placed on the inner side.

Figure 8:
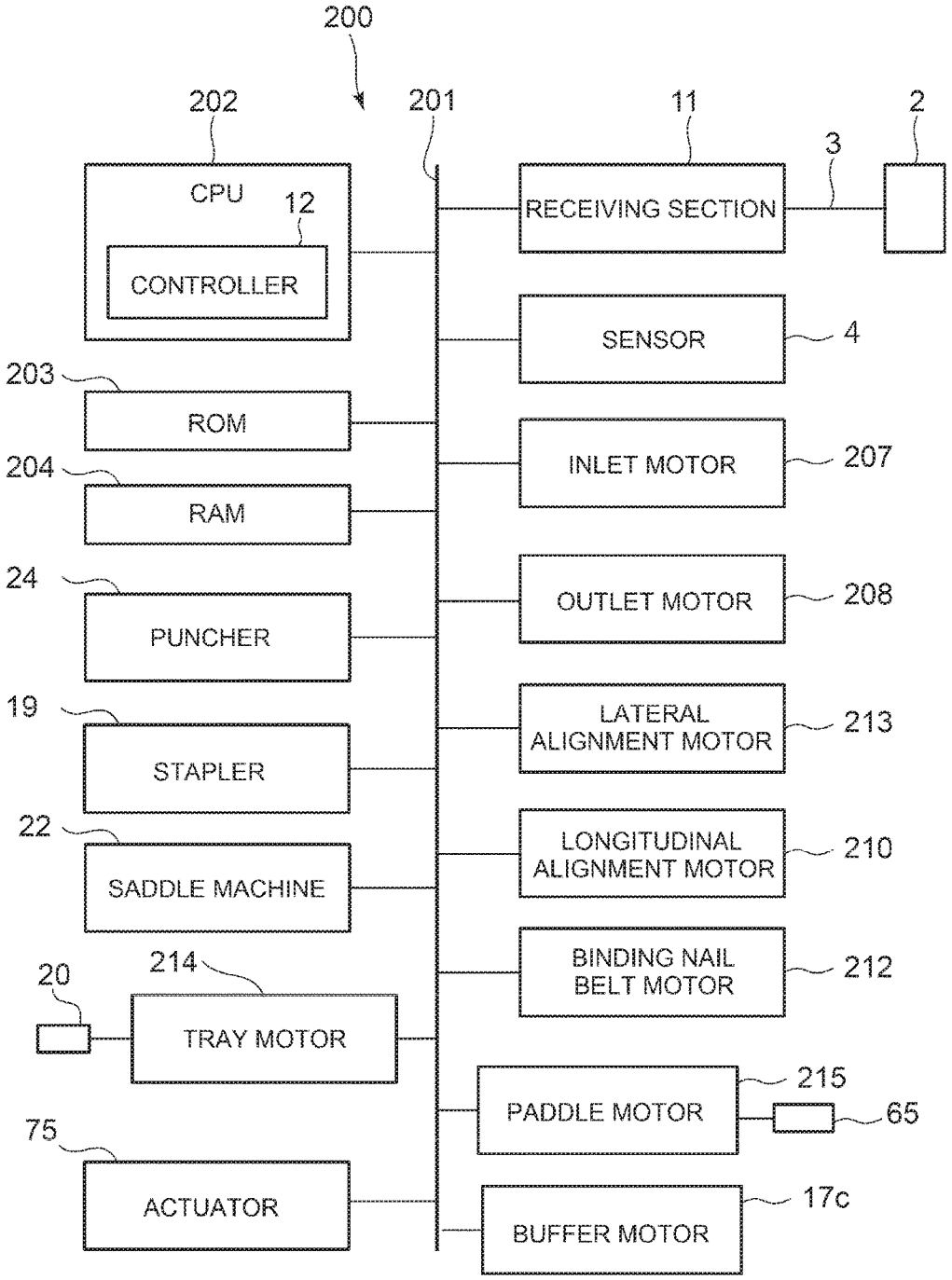
FIG. 8 is a block diagram of a control system of the post-processing apparatus.

FIG. 8 is a block diagram of a control system of the post-processing apparatus 1. In the figure, although the post-processing apparatus 1 includes a plurality of the same components, only one component is sometimes shown.

A control system 200 includes, on a bus 201, a CPU (Central Processing Unit) 202, a ROM (Read Only Memory) 203, and a RAM (Random Access Memory) 204.

The CPU 202 executes the function of the controller 12 in conjunction with the ROM 203 and the RAM 204. The controller 12 controls the operation of post-processing apparatus 1. The controller 12 controls conveyance of a sheet.

The ROM 203 stores various kinds of processing speed in the printing mode and various kinds of processing speed in the decoloring mode.

The ROM 203 stores values of the various kinds of processing speeds for each of the modes. The ROM 203 stores, for example, a value of sheet conveying speed by the inlet rollers 13 and the outlet rollers 15, start timing, end timing, and driving time length of the inlet rollers 13 and the outlet rollers 15, the number of sheets put on standby by the buffer section 60, feeding start timing of a sheet from the buffer section. 60 to the processing tray 18 and a standby time of the sheet, aligning operation speed of the lateral alignment plates 18*c* and 18*d*, operation speed of the ejectors 72, and traveling speed of the binding nail belt 64.

According to a notification signal received from the MFP 2 via the receiving section 11, the controller 12 instructs the puncher 24, the stapler 19, and the saddle machine 22 whether operations of the receiving section 11, the puncher 24, the stapler 19, and the saddle machine 22 are necessary.

The control system. 200 includes an inlet motor 207, an outlet motor 208, the lateral alignment motor 213, the longitudinal alignment motor 210, the binding nail belt motor 212, a paddle motor 215, a tray motor 214, and the buffer motor 17*c*. The inlet motor 207 rotates the inlet rollers 13. The outlet motor 208 rotates the outlet rollers 15. The paddle motor 215 rotates the plurality of paddles 65. The tray motor 214 moves the discharge tray 20 up and down.

The control system 200 includes a plurality of sensors 4 that respectively detect a sheet. The sensors 4 are provided in paths defined between the inlet roller 13 and a plurality of discharge ports such as discharge tray 20 and saddle tray 56. The controller 12 detects a jam or passage of the sheet according to outputs of the sensors 4.

The control system 200 includes the receiving section 11. The receiving section 11 receives a communication signal from the MFP 2 with a serial signal line 3. The receiving section 11 receives a mode identification signal from the MFP 2. The mode identification signal indicates whether an operation mode of the MFP 2 is the printing mode or the decoloring mode, and which printing mode is being used.

The receiving section 11 receives a signal indicating the number of sheets output from the MFP 2. The receiving section 11 receives a signal indicating necessity of post-processing such as stapling, punching, and folding from the MFP 2. As the receiving section 11, for example, an IC (integrated circuit) of a serial communication module is used. The receiving section 11 receives, for example, a signal conforming to the UART (Universal. Asynchronous Receiver/Transmitter). The receiving section 11 also functions as a transmitting and receiving section that transmits a signal to the MFP 2.

The serial signal line 3 may be, for example, a serial cable. A transmitting section. 107 on the MFP 2 side is also an IC of a serial communication module conforming to the UART. After the post-processing apparatus 1 and the MFP 2 are started, the receiving section 11 always receives a signal from the transmitting section 107 for each job.

The controller 12 determines a path of a sheet according to a notification signal received from the MFP 2. The controller 12 instructs the inlet motor 207, the outlet motor 208, a motor in the sheet dividing section 52, and a motor of the flapper 14 whether operations of the motors are necessary. The controller 12 reduces speed for conveying a decolored sheet to be lower than speed for conveying a printed sheet. The controller 12 also reduces speed for conveying a decolored sheet to be lower than speed for conveying a non-decolored sheet.

The controller 12 increases an interval for conveying a plurality of decolored sheets to be longer than an interval for conveying a plurality of printed sheets. The controller 12 also increases the internal for conveying a plurality of decolored sheets to be longer than an interval for conveying a plurality of non-decolored sheets. For example, the controller 12 reduces productivity of the post-processing apparatus 1 in the decoloring mode to be lower than productivity in printing when using non-decolored sheets, or in printing when using decolored sheets. The productivity indicates a time interval between two consecutive sheets. In other words, the productivity indicates the processing speeds of a sheet by the image forming apparatus. Reducing productivity means that the processing speed of a sheet becomes lower.

The controller 12 determines, according to notification from the receiving section 11 indicating a cumulative number of times a sheet has been decolored, whether a sheet conveyed from the MFP 2 is a decolored sheet or a non-decolored sheet.

For example, if the cumulative number of times a sheet has been decolored is one to four, the sheet is a decolored sheet, and the controller 12 reduces post-processing speed of the sheet relative to that of a sheet for which the cumulative number of times the sheet has been decolored is zero.

The controller 12 controls the stapler 19 according to notification from the receiving section 11 to reduce the maximum number of stapled sheets for decolored sheets.

The controller 12 detects a jam on the basis of inputs from the sensors 4 and uses a different method of detecting the jam for decolored sheets, decolored printed sheets, and non-decolored sheets. For example, the controller 12 increases a jam detection time during decoloring to be long compared with a jam detection time during normal printing. The controller 12 also reduces the maximum number of stacked sheets on the discharge tray 20 for decolored sheets versus printed sheets. Further, the controller 12 controls the buffer section. 60 to reduce the number of sheets to be buffered for decolored sheets versus printed sheets.

The control method is for the post-processing apparatus according to the embodiment. The method includes receiving a signal from the MFP 2 and controlling the post-processing section 10 (FIG. 1) to reduce post-processing speed for a decolored sheet to be lower than post-processing speed for a printed sheet.

The post-processing apparatus 1 is explained above. A decoloring function of the MFP 2 is explained below.

Figure 9:
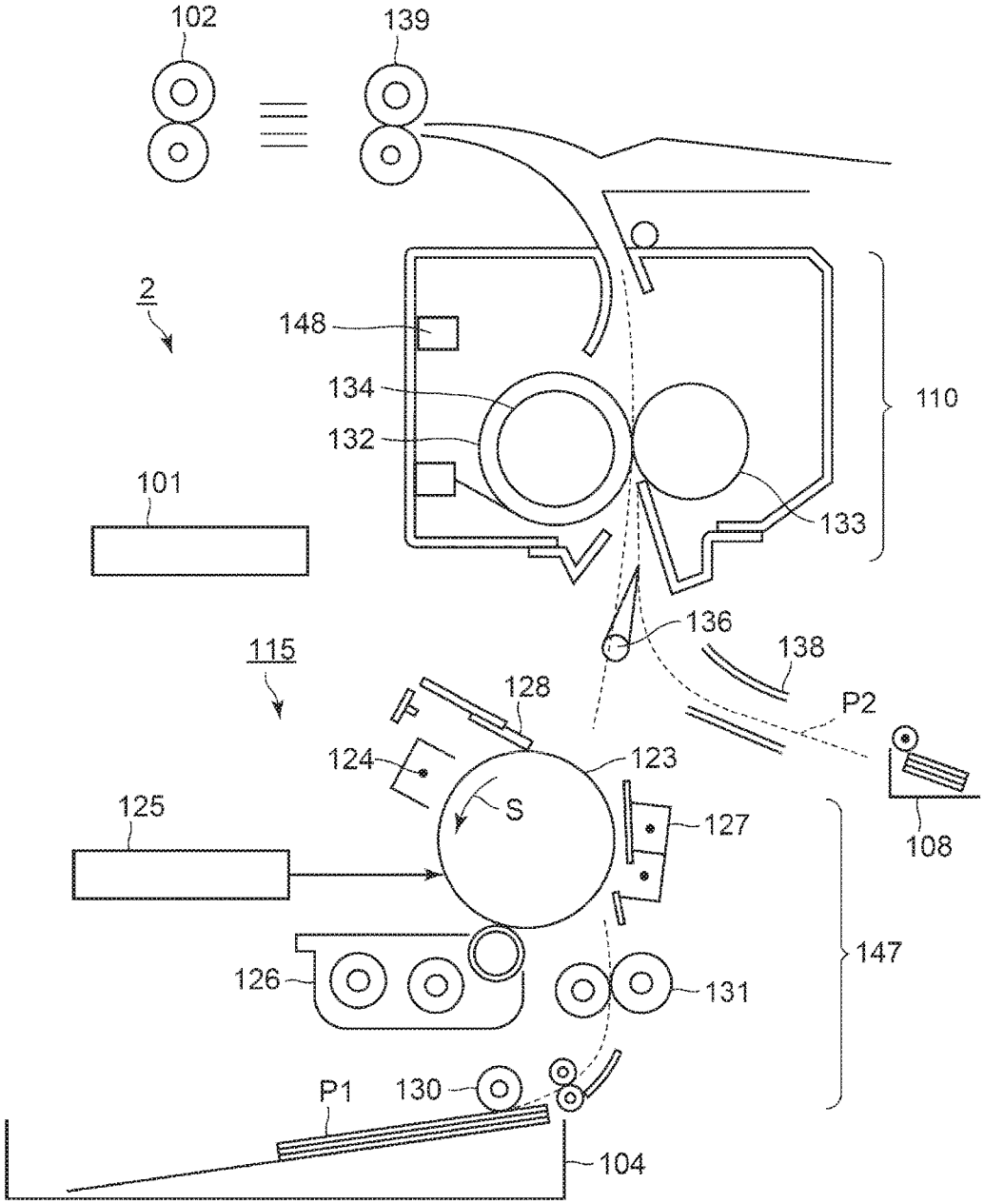
FIG. 9 is a configuration diagram of an image forming apparatus coupled to the post-processing apparatus.

FIG. 9 is a configuration diagram of the MFP 2. The MFP 2 includes the printing section 115, the decoloring section 110 (functioning as the fixing device when using non-decolorable toner), and a controller 101.

The printing section 115 forms an image on a sheet fed from one of cassettes 104 and 105 and discharges the sheet on which an unfixed toner image is carried. As an example, new sheets are set in the cassette 104. Decolored sheets are set in the cassette 105.

The decoloring section 110 fixes the unfixed toner image received from the printing section 115. Alternatively, the printing section 115 executes decoloring on a sheet fed from a cassette 108. The cassette 108 is a manual feed cassette. The decoloring section 110 removes color of an image on a sheet on which the image is formed using decolorable toner by applying heat to the decolorable toner.

The controller 101 switches the operation mode of the MFP 2 between printing modes and decoloring mode. The controller 101 causes the MFP 2 to execute one of the printing mode and the decoloring mode. The MFP 2 does not simultaneously execute printing and the decoloring. The MFP 2 includes the cassettes 104 an 105 of sheets to be printed and the cassette 108 of sheets to be decolored. The MFP 2 changes a rotating position of a flapper 136 according to the operation mode of the MFP 2.

The MFP 2 conveys, using the flapper 136, one of a sheet (represented as P1) fed from the printing section 115 and a sheet (represented as P2) fed from the cassette 108 to the decoloring section 110. The decoloring section. 110 includes a heat roller 132, a press roller 133, an IH (Induction Heating) coil 134, and a controller 148. The heat roller 132 and the press roller 133 hold a sheet and heat and pressurize the sheet. The heat roller 132 heats and conveys the sheet. The press roller 133 presses the sheet held between the heat roller 132 and the press roller 133. The IH coil 134 is a heating source of the heat roller 132.

The controller 148 switches the temperature of the surface of the heat roller 132 depending on whether the job is a printing job or a decoloring job. The controller 148 controls an electric current of the IH coil 134.

As the decolorable toner, a decolorable color material is used. The decolorable color material includes a color assuming compound, a color developing agent, and a decolorizer. The color assuming compound is a leuco dye. The color developing agent is a phenolic compound. The decolorizer is a substance melted together with the color assuming compound by heating. As the decolorizer, a substance not having affinity with the color developing agent is used.

The decolorable color material develops a color according to interaction of the color assuming compound and the color developing agent. In the decolorable color material, the interaction of the color assuming compound and the color developing agent is interrupted by heating to a decoloring temperature or temperature higher than the decoloring temperature. The color material is decolored by the interruption of the interaction.

In FIG. 9, the printing section 115 forms a toner image on a sheet. The printing section. 115 includes a photoconductive drum 123, a charging device 124, an exposing device 125, a developing device 126, a transfer device 127, and a cleaner 128. The photoconductive drum 123 rotates in a counterclockwise direction S in the figure. The charging device 124 charges the surface of the photoconductive drum 123. The exposing device 125 radiates a laser beam or LED (light emitting diode) light on the surface of the photoconductive drum 123. The developing device 126 develops an electrostatic latent image on the photoconductive drum 123 with a toner. The transfer device 127 transfers a toner image onto a sheet. The cleaner 128 cleans the surface of the photoconductive drum 123.

In the printing mode, the controller 101 starts to move the photoconductive drum 123 according to occurrence of the printing job on an operational panel 106 (FIG. 1). The charging device 124 charges the surface of the photoconductive drum 123 at a fixed voltage. The exposing device 125 modulates the light with image data. The exposing device 125 radiates the light in a radiation position on the photoconductive drum 123. A pair of pickup rollers 130 picks up a sheet from the cassette 104. A conveying mechanism 147 feeds the sheet. The conveying mechanism 147 includes a plurality of pairs of rollers, a motor for driving and a guide of each of the rollers (not shown). A pair of registration rollers 131 adjusts timing for conveying the sheet to the transfer device 127 to match the time to generate the toner image.

The decoloring section 110 fixes the toner image (of non-decolorable toner) on the sheet above the printing section 115.

The MFP 2 includes one or more pairs of conveying rollers 139 downstream, in a sheet conveying direction, from the decoloring section 110. The MFP 2 outputs the sheet from the pair of discharge rollers 102.

In the decoloring mode, the controller 101 receives an input of a start of the decoloring job to the operational panel 106 (FIG. 1). The conveying mechanism 147 conveys the sheet from the cassette 108 to the decoloring section 110 via a guide 138. The controller 148 of the decoloring section 110 controls the temperature of the surface of the heat roller 132 to be adjusted to a predetermined temperature in the decoloring job. The decoloring section 110 removes a color of the toner by heating the toner. The MFP 2 discharges the sheet after the decoloring from the pair of discharge rollers 102.

The operation of the post-processing apparatus 1 is explained. In FIG. 1, it is assumed that the operation mode of the MFP 2 is the printing mode, specifically, a normal printing mode.

The MFP 2 receives a user operation input of "copy" to the operational panel 106. The user operation input is, for example, designation concerning each of a sheet size, a sheet type, a sheet direction, and the number of copies, information concerning whether printing is duplex printing or simplex printing, and information concerning necessity of post-processing such as punching, stapling, sorting, and saddle folding.

The MFP 2 forms images one after another on, for example, sheets fed from the cassette 104 due to occurrence of the printing job.

The MFP 2 notifies, for example, printing conditions described below to the post-processing apparatus 1: a mode type "printing mode", a sheet size "ISO A4", a sheet type "plain paper", a sheet direction "sheet longitudinal direction", the number of copies "100", "simplex printing", and the post-processing "presence of sorting". The post-processing apparatus 1 may receive, from the MFP 2, a command representing a time interval between two sheets to be continuously conveyed.

Figure 10:
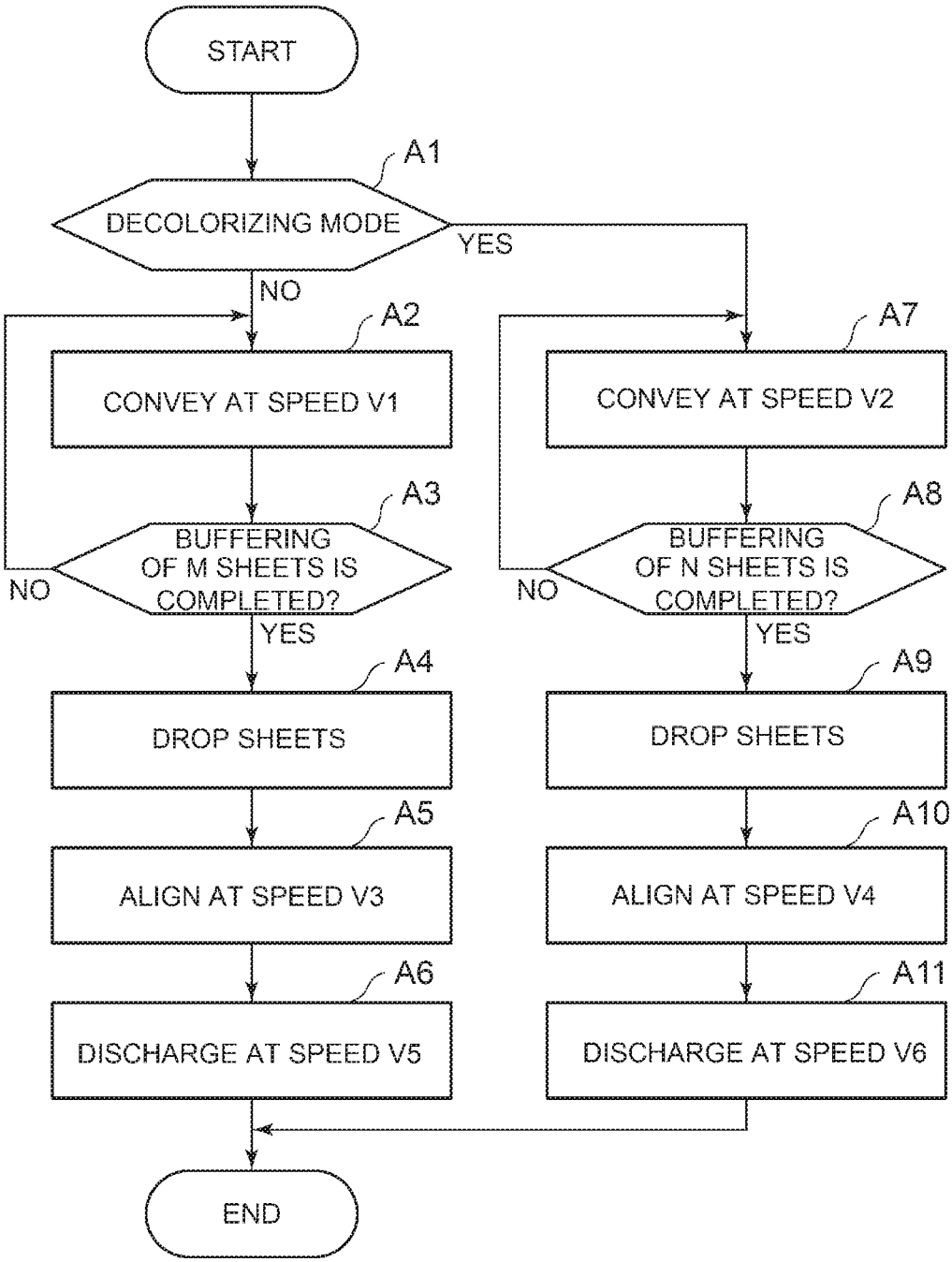
FIG. 10 is a flowchart for explaining operation in each of printing and decoloring of the post-processing apparatus.

FIG. 10 is a flowchart for explaining operation in each of the printing and the decoloring of the post-processing apparatus according to the embodiment. In the figure, V1, V2, V3, V4, V5, and V6 represent speed values, M and N represent natural numbers, and relations of V1>V2, M>N, V3>V4, and V5>V6 are satisfied.

In the post-processing apparatus 1, the controller 12 receives, from the receiving section 11, notification of a printing start output by the MFP 2. The controller 12 starts processing shown in FIG. 10 according to notification. In Act A1, the controller 12 determines whether the operation mode is the decoloring mode. The controller 12 shifts to processing in Act A2 through a NO route according to a determination result in Act A1 indicating that the operation mode is not the decoloring mode.

In Act A2, the controller 12 refers to the ROM 203 and, in the printing mode, rotates the inlet motor 207 and the outlet motor 208 at normal speed. The inlet rollers 13 and the outlet rollers 15 convey a sheet at sheet conveying speed V1.

Subsequently, in Act A3, the controller 12 determines whether buffering of M sheets is completed. In the printing mode, the controller 12 reads a value M from the ROM 203. The buffer section 60 continues to buffer sheets until the number of sheets reaching the buffer section 60 reaches M. In Act A3, the controller 12 controls the paddle motor 215, the buffer motor 17*c*, the actuator 75, and a conveying motor on the upstream side of the buffer section 60. The controller 12 repeats the processing in Acts A2 and A3 through a NO route according to the determination in Act A3 until the number of buffered sheets reaches M.

For example, the controller 12 counts, according to an output of the sensor 4 present upstream of an inlet of the buffer section 60, the number of sheets passed through the sensor 4. The controller 12 executes the processing in Act A3 according to a count value and the received printing conditions. If the number of buffered sheets reaches M in Act A3, the controller 12 shifts to Act A4 through a YES route. In Act A4, the controller 12 causes the buffer section 60 to drop the buffered M sheets onto the processing tray 18.

In Act A5, the controller 12 causes the processing tray 18 to align the sheets in the longitudinal direction and the lateral direction. In Act A5, the controller 12 drives the lateral alignment motor 213 at normal speed. The lateral alignment plates 18*c* and 18*d* laterally align the sheets at sheet processing speed V3. The controller 12 may drive the longitudinal alignment motor 210 and the paddle motor 215 at the normal speed. The controller 12 may control the upper longitudinal alignment rollers 71, the lower longitudinal alignment rollers 62, the paddle motor 215, and the like.

In Act A6, the controller 12 drives the binding nail belt motor 212 and the tray motor 214 at the normal speed. The ejectors 72 and the binding nail belt 64 discharge the sheets at sheet discharge speed V5. The post-processing apparatus 1 sorts the sheets and discharges a bundle of the sheets aligned onto the discharge tray 20.

Subsequently, the operation of the post-processing apparatus 1 performed when the MFP 2 conveys a decolored sheet to the post-processing apparatus 1 in the decoloring mode is explained. Prior to Act A1 in FIG. 10, the MFP 2 switches the operation mode from the printing mode to the decoloring mode.

In the printing job, the decoloring section 110 sets a fixing temperature to, for example, 100° C. or less, for example, 80° C. In the decoloring job, the decoloring section 110 sets a decoloring temperature to 90° C. or more, for example, 140° C.

The controller 101 of the MFP 2 reduces productivity at a decoloring temperature of the heat roller 132 to be lower than productivity in the printing mode to provide longer heating time by the IH coil 134 (a heating source). The productivity indicates a time interval between two consecutive sheets. The controller 101 may reduce the productivity according to the cumulative number of times of decoloring of the sheet. The number of times of decoloring is input to the operational panel 106 by the user.

After the decoloring section 110 is sufficiently heated, the MFP 2 receives the user operation input.

The user sets a sheet, having an image printed thereon in decolorable toner, in the cassette 108, A decoloring button is selected by the user via operational panel 106*t*. The MFP 2 decolors, according to occurrence of the decoloring job, for example, the image on the sheet fed from the cassette 108.

The MFP 2 notifies the following decoloring conditions to the post-processing apparatus 1: the mode type "decoloring mode", the sheet size "ISO A4", the sheet type "plain paper", the sheet direction "sheet longitudinal direction", the number decolored sheets "50", "simplex", and the post-processing "presence of sorting" In Act 1, the controller 12 receives notification of a decoloring start output by the MFP 2 and determines whether the operation mode is the decoloring mode.

The controller 12 shifts to Act A7 through a YES route according to a determination result in Act A1 indicating that the operation mode is the decoloring mode. In Act A7, the controller 12 refers to the ROM 203 and reads a speed value in the decoloring mode. In the decoloring mode, the controller 12 rotates the inlet motor 207 and the outlet motor 208 at speed lower than the normal speed. The inlet rollers 13 and the outlet rollers 15 convey a sheet at sheet conveying speed V2. The controller 12 reduces driving speed of the plurality of pairs of rollers that convey the sheet. The controller 12 increases a j am detection time for detecting a jam using outputs from the plurality of sensors 4.

In the printing mode, the sensor 4 outputs a sheet detection signal continuously for approximately 1.0 second, whereby the controller 12 detects a jam on the sensor 4. In the decoloring mode, the sensor 4 outputs a sheet detection signal continuously for approximately 1.5 seconds, whereby the controller 12 detects a jam on the sensor 4.

The sheet in the decoloring mode is conveyed at the sheet conveying speed V2 lower than the sheet conveying speed V1 in the printing mode.

Subsequently, in Act A8, the controller 12 determines whether buffering of N (M>N) sheets is completed. The controller 12 reads a number-of-buffered-sheets setting value N in the decoloring mode. The buffer section 60 continues to buffer sheets until the number of sheets reaching the buffer section 60 reaches N.

The controller 12 repeats the processing in Acts A7 and A8 through a. NO route according to the determination in Act A8 until the number of buffered sheets reaches N. For example, according to a count value of the number of sheets passed through the sensors 4 and the received decoloring conditions, in Act A8, the controller 12 determines that the number of buffered sheets reaches N. For example, whereas five sheets are buffered at a time in the printing mode, two sheets are buffered at a time in the decoloring mode. If the number of buffered sheets reaches N, as determined at Act A8, the controller 12 shifts to Act A9 through a YES route. In Act A9, the controller 12 causes the buffer section 60 to drop the buffered N sheets onto the processing tray 18.

In Act A10, the controller 12 causes the processing tray 18 to align the sheets in the longitudinal direction and the lateral direction. In Act A10, the controller 12 drives the lateral alignment motor 213 at speed lower than the normal speed. The lateral alignment plates 18*c* and 18*d* laterally align the sheets at sheet processing speed 4.

The controller 12 reduces longitudinal alignment processing speed in the decoloring mode to be lower than longitudinal alignment processing speed in the printing mode. The sheets in the decoloring mode are aligned at the sheet processing speed V4 lower than the sheet processing speed V3 in the printing mode.

In Act A11, the controller 12 drives the binding nail belt motor 212 and the tray motor 214 at speed lower than the speed in the printing mode. The ejectors 72 and the binding nail belt 64 discharge the sheets at sheet discharge speed V6. The sheets in the decoloring mode are discharged at the sheet discharge speed V6 lower than the sheet discharge speed V5 in the printing mode.

In the decoloring mode, the controller 12 reduces the maximum number of stacked sheets of the discharge tray 20. This is because a decolored sheet is easily curled. For example, the controller 12 changes the maximum number of stacked sheets from 3000 in the printing mode to the maximum number of stacked sheets of 2500 in the decoloring mode. If the maximum number of stacked sheets is reduced, even if curled sheets are laid one on top of another, the height of a sheet bundle does not exceed a sheet bundle of normally printed. Therefore, a sheet does not jam in the discharge tray 20.

As the speeds V1 to V6, various values are written in the ROM 203 in advance according to a sheet size, a sheet type, sheet thickness, printing concentration, and the like. The values reflect results of experiments, field tests, and simulations.

In a third mode different from the normal printing mode, if printing is performed on a decolored sheet fed from the cassette 105, the post-processing apparatus 1 may reduce speed according to the processing in Acts A7 to A11. In particular, in the MFP 2, if printing on a decolored sheet and binding by the stapler 19 are selected by a user via operational panel 106, the controller 12 reduces the maximum number of stapled sheets by the stapler 19.

In FIG. 10, in the third mode, which is a printing mode, if the MFP 2 includes punching in the printing conditions, after Act A1 the puncher 24 opens holes in a sheet at lower processing speed stored in the ROM 203. Similarly, if the printing conditions include presence of stapling, in Acts A5 and A6, the stapler 19 staples the sheet bundle at lower processing speed. Thereafter, the post-processing apparatus discharges the sheet bundle. If the printing conditions include presence of saddle folding, the controller 12 causes the saddle machine 22 to perform at lower processing speed stored in the ROM 203. The intermediate rollers 25 and the output rollers 26 convey the sheets to the tray 27 at lower conveying speed. The stacker 28 stacks the sheets fed from the tray 27 at lower processing speed. The stacker 28 forms a sheet bundle and aligns the sheet bundle.

In summary, in the decoloring mode, compared with the normal printing, the MFP 2 causes a sheet to pass though the decoloring section 110 (the fixing device) controlled to high temperature.

In the decoloring mode, the sheet is heated at high temperature. Because of the heating, the sheet loses sturdiness, which is strength, stiffness, or curl resistance, and is conveyed to the post-processing apparatus 1 in a state in which the sheet has a large curl. The post-processing apparatus 1 executes, in the decoloring mode, the post-processing at speed lower than post-processing speed in the printing mode. Therefore, an alignment failure and a jam are not caused. If the MFP 2 signals the decoloring mode, the post-processing apparatus 1 respectively reduces the conveying speed, the aligning operation speed, and the discharge speed to be lower than those in the printing mode. The post-processing apparatus 1 increases the jam detection time and reduces the number of buffered sheets.

If the MFP 2 executes printing on a decolored sheet and the post-processing apparatus 1 performs binding by the stapler 19, the post-processing apparatus 1 reduces the maximum number of bound sheets. If the maximum number of bound sheets is reduced, the stapler 19 can bind a bundle of curled sheets without an error.

Since the productivity of the MFP 2 is reduced according to the cumulative number of decoloring of a sheet, a jam of sheet does not occur in the post-processing apparatus 1. The post-processing apparatus, according to this embodiment, stacks sheets on the discharge tray 20 and discharges the sheets without causing an alignment failure and a jam of the sheets in the decoloring mode. The post-processing apparatus 1 can thus improve performance representing the number of sheets output by the post-processing apparatus 1 per unit time.

The speeds V1 and V2 in FIG. 10 represent the sheet conveying speeds by the inlet rollers 13, the outlet rollers 15, and the like. However, instead of the sheet conveying speeds, the speeds V1 and V2 may represent rotation angular velocities of a driving motor by the inlet motor 207, the outlet motor 208, and the like.

In the above explanation, the post-processing apparatus 1 transmits, to the MFP 2, the command representing the time interval between two consecutive sheets during the sheet conveyance. However, the MFP 2 may transmit the command representing the time interval between the sheets to the post-processing apparatus 1.

In Act A5 in FIG. 10, the processing tray 18 may align the sheets in one of the longitudinal direction and the lateral direction.

As the receiving section 11, a wireless transmission and reception module may be used. As the serial signal line 3, an antenna may be used.

The sheet longitudinal direction indicates a direction in which the sheet is conveyed in a state in which the long side of the sheet is orthogonal to the sheet conveying direction.

Superiority of the post-processing apparatus and the control method for the post-processing apparatus according to the embodiment is not spoiled at all with respect to an implementation product obtained by simply changing and implementing the post-processing apparatus and the control method for the post-processing apparatus.

In the above descriptions of the embodiments, "decoloring" means that the color of an image formed on a sheet is decolored. But "decoloring" may include the meaning that an image is erased. For example, term "decoloring" may include a method for decoloring an image on a sheet by irradiating it with light, erasing by removing an image on a sheet.

While certain embodiments have been described, these embodiments have been presented by way of example only, and are not intended to limit the scope of the inventions. Indeed, the novel methods and systems described herein may be embodied in a variety of other forms; furthermore various omissions and substitutions and changes in the form of methods and systems described herein may be made without departing from the spirit of the inventions. The accompanying claims and their equivalent s are intended to cover such forms or modifications as would fall within the scope and spirits of the inventions.

What is claimed is:

1. A post-processing apparatus comprising:

a post-processing section configured to execute post-processing on a sheet conveyed from an image forming section; and a controller configured to set a first post-processing speed or a first number of sheets to be post-processed if the post-processing section is performing the post-processing on first sheets, the first sheets having been decolored less than a predetermined number of times, and a second post-processing speed or a second number of sheets to be post-processed if the post-processing section is performing the post-processing on second sheets, the second sheets having been decolored at least the predetermined number of times.

2. The apparatus according to claim 1, wherein the second post-processing speed is lower than the first post-processing speed.

3. The apparatus according to claim 2, further comprising:

an interface through which a signal indicating whether a sheet conveyed to the post-processing section is one of the first sheets or one of the second sheets, wherein the controller determines on a basis of the signal, whether the sheet conveyed from the image forming section is one of the first sheets or one of the second sheets.

4. The apparatus according to claim 3, wherein the signal indicates a cumulative number of times the sheet has been decolored.

5. The apparatus according to claim 3, further comprising a sheet sensor, wherein the controller detects a jam on a basis of an output from the sheet sensor, and the controller uses a first method of detecting the jam when the sheet is one of the first sheets and a second method of detecting the jam when the sheet is one of the second sheets.

6. The apparatus according to claim 1, wherein the controller is configured to control the post-processing section to increase an interval between a preceding sheet and a following sheet when conveying the second sheets relative to when conveying the first sheets.

7. A post-processing apparatus comprising:

a post-processing section configured to execute post-processing on a sheet conveyed from an image forming section;

a controller configured to set a first post-processing speed or a first number of sheets to be post-processed if the post-processing section is performing the post-processing on first sheets, the first sheets having been decolored less than a predetermined number of times, and a second post-processing speed or a second number of sheets to be post-processed if the post-processing section is performing the post-processing on second sheets, the second sheets having been decolored at least the predetermined number of times; and a tray on which sheets subjected to the post-processing are stacked, wherein the controller controls the post-processing section to reduce a maximum number of stacked sheets on the tray when the sheets are second sheets relative to when the sheets are first sheets.

8. The apparatus according to claim 1, further comprising:

a buffer section where the sheet conveyed from the image forming apparatus is held temporarily before being subjected to post-processing, wherein the controller controls the buffer section to reduce a number of sheets to be buffered when the sheets to be buffered are second sheets relative to when the sheets to be buffered are first sheets.

9. The apparatus according to claim 1, further comprising a binding section configured to bind sheets, wherein the controller reduces a number of sheets to be bound when the sheets to be bound are second sheets relative to when the sheets to be bound are first sheets.

10. The apparatus according to claim 1, wherein the predetermined number of times is one.

11. A method of controlling a post-processing apparatus comprising:

receiving a signal that indicates that a sheet conveyed from an image forming section to a post-processing section is a first sheet or a second sheet, wherein the second sheet is a sheet that has been decolored at least a predetermined number of times, and the first sheet is a sheet that has been decolored less than the predetermined number of times;

setting a post-processing speed or number of sheets to be post-processed based on the signal; and executing post-processing on the sheet conveyed from the image forming section according to the set post-processing speed or the set number of sheets to be post-processed.

12. The method according to claim 11, wherein the post-processing speed is set lower for the second sheet than for the first sheet.

13. The method according to claim 12, wherein the signal indicates a cumulative number of times the sheet conveyed has been decolored.

14. The method according to claim 13, further comprising:

detecting a jam according to a first method if the sheet conveyed is the first sheet and according to a second method if the sheet conveyed is the second sheet.

15. The method according to claim 11, further comprising:

executing post-processing on successive sheets with a larger time interval when post-processing successive second sheets relative to when post-processing successive first sheets.

16. The method according to claim 11, further comprising:

discharging a post-processed sheet onto a tray, wherein a maximum number of stacked sheets on the tray is smaller for second sheets than for first sheets.

17. The method according to claim 11, further comprising:

buffering sheets conveyed from the image forming section, wherein the number of sheets that are buffered is smaller when the sheets that are buffered are second sheets relative to when the sheets that are buffered are first sheets.

18. The method according to claim 11, wherein the post-processing includes binding the sheets, and the number of sheets to be bound is smaller when the sheets to be bound are second sheets relative to when the sheets to be bound are first sheets.

19. The method according to claim 11, wherein the predetermined number of times is one.

20. The method according to claim 11, wherein the predetermined number of times is more than one.

* * * * *